US009784525B2

(12) United States Patent
Maeda

(10) Patent No.: US 9,784,525 B2
(45) Date of Patent: Oct. 10, 2017

(54) TOY GUN

(71) Applicant: Maruzen Company Limited, Tokyo (JP)

(72) Inventor: Tetsuo Maeda, Tokyo (JP)

(73) Assignee: MARUZEN COMPANY LIMITED, Tokyo (JP)

( * ) Notice: Subject to any disclaimer, the term of this patent is extended or adjusted under 35 U.S.C. 154(b) by 0 days.

(21) Appl. No.: 15/068,339

(22) Filed: Mar. 11, 2016

(65) Prior Publication Data

US 2016/0305736 A1 Oct. 20, 2016

(30) Foreign Application Priority Data

Apr. 14, 2015 (JP) ..... 2015-082646

(51) Int. Cl.
*F41B 11/62* (2013.01)
*F41B 11/89* (2013.01)

(52) U.S. Cl.
CPC ..... *F41B 11/62* (2013.01); *F41B 11/89* (2013.01)

(58) Field of Classification Search
CPC ..... F41B 11/62; F41B 11/72–11/724
See application file for complete search history.

(56) References Cited

U.S. PATENT DOCUMENTS 3,788,298 A * 1/1974 Hale ..... F41B 11/62 124/31
3,999,534 A * 12/1976 Chapin ..... F41B 11/62 124/49
4,150,656 A * 4/1979 Curran ..... F41B 11/62 124/74
6,029,645 A * 2/2000 Wonisch ..... F41B 11/62 124/74
6,494,194 B2 * 12/2002 Shipachev ..... F41A 9/76 124/31

(Continued)

FOREIGN PATENT DOCUMENTS

DE 195 42 326 A1 5/1997
TW M368052 U 11/2009

OTHER PUBLICATIONS

Extended search report issued in European Application No. 16000142.6, dated Aug. 17, 2016.

(Continued)

*Primary Examiner* — Stephen M Johnson
*Assistant Examiner* — Joshua Semick
(74) *Attorney, Agent, or Firm* — Michael Best & Friedrich LLP

(57) ABSTRACT

A simple apparatus which prevents a danger that a gas cylinder with gas left in the cylinder leaps out when the gas cylinder is taken out to change a gas cylinder is provided. A toy gun 1 includes: a gas cylinder housing portion 11 which is provided in the grip portion of an air gun and houses a gas cylinder 31; a clamp 41 which opens or closes the gas cylinder housing portion 11; a clamp pivot 42 about which the clamp 41 is rotated; a roller 14 installed at the bottom portion of the gas cylinder housing portion 11; and a receptacle 21 which is installed between the upper part of the roller 14 and the bottom portion of the gas cylinder 31 and is energized toward the roller 14 and whose surface shape is matched with the bottom face shape of the gas cylinder 31.

18 Claims, 9 Drawing Sheets

(56) References Cited

U.S. PATENT DOCUMENTS

| | | | | |
|---|---|---|---|---|
| 7,290,539 | B2 * | 11/2007 | Maeda | F41B 11/62 124/63 |
| 7,730,882 | B2 * | 6/2010 | Liu | F41B 11/62 124/74 |
| 8,550,061 | B2 * | 10/2013 | Maeda | F41B 11/56 124/56 |
| 8,550,062 | B2 * | 10/2013 | Maeda | F41B 11/62 124/56 |
| 2008/0141991 | A1 | 6/2008 | Liu | |

OTHER PUBLICATIONS

Search Report issued in Taiwan Patent Application No. 105102509, dated Jan. 6, 2017.

* cited by examiner

TOY GUN

CROSS-REFERENCE TO RELATED APPLICATION(S)

This application is based upon and claims the benefit of priority from Japanese Patent Application JP2015-082646, filed on Apr. 14, 2015, the entire disclosure of which is incorporated herein by reference.

TECHNICAL FIELD

The present invention relates to toy guns and in particular to a housing mechanism of a gas cylinder for housing gas, such as air, used to fire bullets, such as BB bullets, with a toy gun.

BACKGROUND ART

As housing mechanisms of gas cylinders for housing gas, such as air, used to fire bullets, such as BB bullets, with a conventional toy gun, for example, "toy guns," protected by the patents owned by the present applicant, are known (Patent Document 1: U.S. Pat. No. 7,290,539, Patent Document 2: U.S. Pat. No. 8,550,062).

Housing mechanisms of gas cylinders for housing gas, such as air, used to fire bullets, such as BB bullets, with a toy gun pose a problem when a lever is used to change a gas cylinder. A gas cylinder is opened when the cylinder is changed. When a gas cylinder with gas left in the cylinder is taken out, the cylinder is quickly opened. Therefore, there is a danger that the gas cylinder leaps out jetting residual gas out of the unsealed hole.

To cope with this, various attempts have been conventionally made, for example, the inlet of a gas cylinder opened in a frame is narrowed as much as possible or a movable guard is provided for the prevention of leaping-out.

[Patent Document 1] U.S. Pat. No. 7,290,539

[Patent Document 2] U.S. Pat. No. 8,550,062

SUMMARY OF THE INVENTION

Technical Problem

When a gas cylinder with gas left in the cylinder is taken out to change a gas cylinder, the cylinder is quickly opened. Therefore, there is a danger that the gas cylinder leaps out jetting residual gas out of the unsealed hole and it has been necessary to provide a simple apparatus to prevent this danger.

It is an object of the present invention to provide a simple apparatus which prevents a danger that a gas cylinder with gas left in the cylinder leaps out when the gas cylinder is taken out to unseal a gas cylinder.

Solution to Problem

The toy gun of the present invention comprises:

a gas cylinder housing portion which is provided in the grip portion of an air gun and houses a gas cylinder;

a clamp which closes or opens the gas cylinder housing portion;

a clamp pivot about which the clamp is rotated;

a roller installed at the bottom portion of the gas cylinder housing portion; and a receptacle which is installed between the upper part of the roller and the bottom portion of the gas cylinder, is energized toward the roller, and has a surface shape matched with the bottom surface shape of the gas cylinder.

The toy gun of the present invention may further comprise the receptacle having a concave spherical surface when the bottom face of the gas cylinder is a convex spherical surface.

The toy gun of the present invention may further comprise the receptacle in which its periphery is in a raised shape.

The toy gun of the present invention may further comprise the receptacle in which the raised shape provided on its periphery is higher on the opening side than on the rear side.

The toy gun of the present invention may further comprise the receptacle which is raised more at the corners than in the center on the opening side.

Effects of Invention

According to the present invention, a simple apparatus which prevents a danger that a gas cylinder with gas left in the cylinder leaps out when the gas cylinder is taken out to unseal a gas cylinder.

DETAILED DESCRIPTION OF THE PREFERRED EMBODIMENTS

Figure 1:
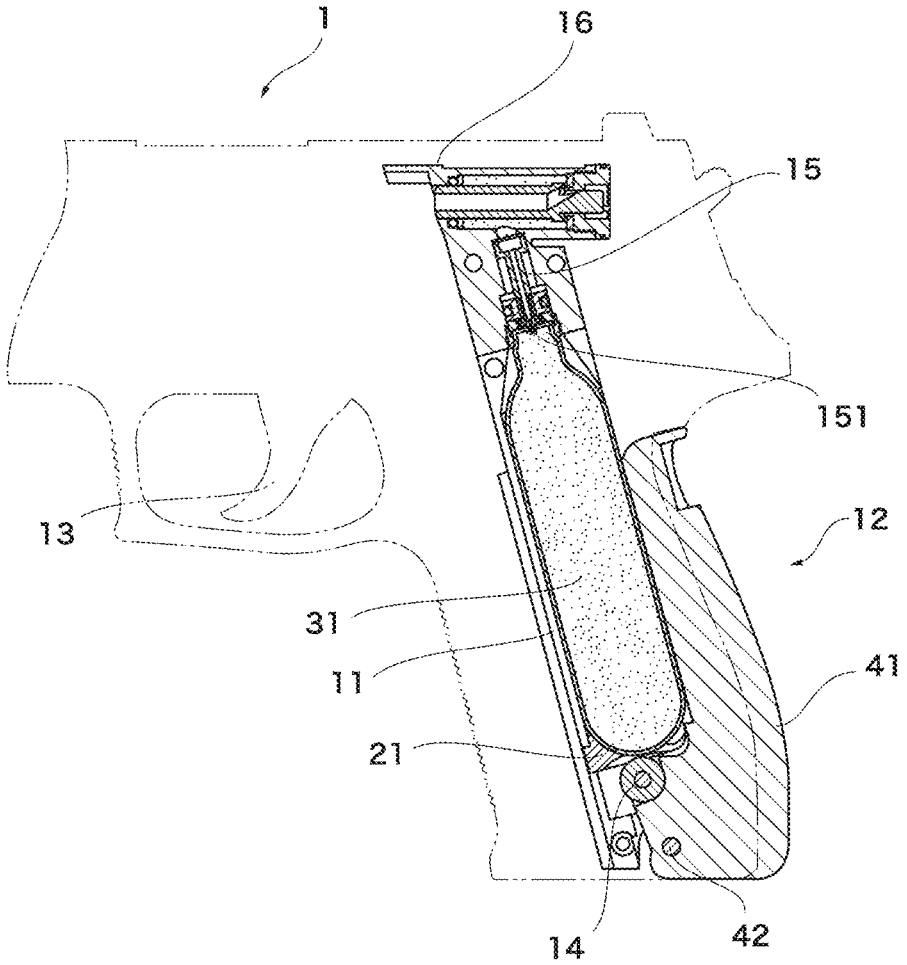
FIG. 1 is a partial front sectional view of a toy gun in an embodiment of the present invention as is in use.

A description will be given to an embodiment of the present invention with reference to the drawings illustrating the embodiment of the present invention.

Reference numeral 1 denotes a toy gun; 12 denotes the grip portion of the toy gun 1; and 13 denotes a trigger. To operate the trigger 13, the grip portion 12 is grasped.

Reference numeral 11 denotes a gas cylinder housing portion. The gas cylinder housing portion 11 is provided in the grip portion 12 of the toy gun 1 which is an air gun and houses a gas cylinder 31. The gas cylinder 31 is a metal cylinder as a whole and the tip of the cylinder is reduced in diameter and the bottom face of the cylinder is a convex spherical surface.

Reference numeral 16 denotes an air chamber. The air chamber 16 is provided above the grip portion 12. Reference numeral 15 denotes a piercing pin and 151 denotes a piercing pin 15 tip portion. The base portion of the piercing pin 15 is attached to the air chamber 16 and guides gas from the piercing pin tip portion 151 into the air chamber 16 by way of the piercing pin 15.

Reference numeral 14 denotes a roller. The roller 14 is installed at the bottom portion of the gas cylinder housing portion 11.

Reference numeral 41 denotes a clamp. Reference numeral 42 denotes a clamp pivot about which the clamp 41 is rotated. The clamp 41 is rotated about the clamp pivot 42 to open or close the opening 17 in the gas cylinder housing portion 11. At this time, the clamp 41 is rotated about the clamp pivot 42 to press the roller 14 against a receptacle 21 from below using the principle of leverage. This causes the pressed receptacle 21 to fit the gas cylinder 31 upward.

In this embodiment, the clamp 41 is opened rearward of the toy gun 11. Instead, the clamp 41 may be opened sideward.

Reference numeral 21 denotes the receptacle. The receptacle 21 is installed between the upper part of the roller 14 and the bottom portion of the gas cylinder 31 housed in the gas cylinder housing portion 11. Reference numeral 51 denotes a spring and 52 denotes a rail portion. The rail portion 52 is provided in the shape of a long groove in a side face of the grip portion 12 to the direction of the air chamber 16 and the clamp pivot 42. The spring 51 is provided in the rail portion 52 and can be slid along the rail portion 52 to the direction of the air chamber 16 and the clamp pivot 42. The spring 51 energizes the receptacle 21 toward the clamp pivot 42. The receptacle 21 has an upper face shape matched with the bottom face shape of the gas cylinder 31. In this example, since the bottom face of the gas cylinder 31 is a convex spherical surface, the surface of the receptacle 21 is a concave spherical surface as illustrated in FIG. 1, FIG. 2, FIG. 4, FIG. 6, and FIG. 8 to FIG. 11.

Since the receptacle 21 has a concave spherical surface, the central part 23 of the receptacle constitutes the bottom portion of the concave spherical surface. The receptacle is provided in the central part with a hole 24. The hole 24 is rectangular. The roller 14 is provided so that the roller is slightly protruded from the hole 24 and can be abutted against the gas cylinder 31. This is because a problem otherwise arises when the clamp 41 is pressed against the receptacle 21 to house the gas cylinder 31. The force by which the roller presses the receptacle 21 is insufficient. By pressing the roller 14 directly against a gas cylinder 31, the gas cylinder 31 is unsealed by the piercing pin 15 without fail. The vicinity of the central part 23 of the receptacle includes raised opening side wall 22B, opening side wall 22B, a rear wall 22C, and an opening central recess 22A provided between the opening side walls 22B.

The opening central recess 22A is a curved recess matched with the curve of the bottom face of the gas cylinder 31 which is lowered as it goes toward the center.

The opening side wall 22B and the opening side wall 22B are walls higher than the center of the bottom face, from the open face to the side faces. The raised walls provided around the receptacle 21 are so formed that the following is implemented: the opening side wall 22B and the opening side wall 22B located on both sides of the opening are higher than the rear wall 22C which is located on the rear side and is also a side wall. This makes it possible to prevent the gas cylinder 31 from leaping out toward the opening 17.

The three protrusions vertically provided on the side face and rear face of the rear wall 22C are locking portions 25. The locking portions 25 secure the bottom portion of the receptacle 21 when the receptacle 21 is attached to the grip portion 12.

A description will be given to the action of the embodiment.

The gas cylinder 31 is pressed upward and housed by pressing the clamp 41 against the receptacle 21 by using leverage with the clamp pivot 42 being as the rotation axis. Then the piercing pin tip portion 151 of the piercing pin 15 is pierced into the upper part of the gas cylinder 31 and unseals the gas cylinder 31.

In the state illustrated in FIG. 1, the piercing pin tip portion 151 has already been pierced into the tip of the gas cylinder 31 and the gas cylinder 31 has been unsealed. The air chamber 16 has been filled with gas through the piercing pin 15. The clamp 41 has been closed and the gas cylinder 31 has been housed in the gun body.

Figure 2:
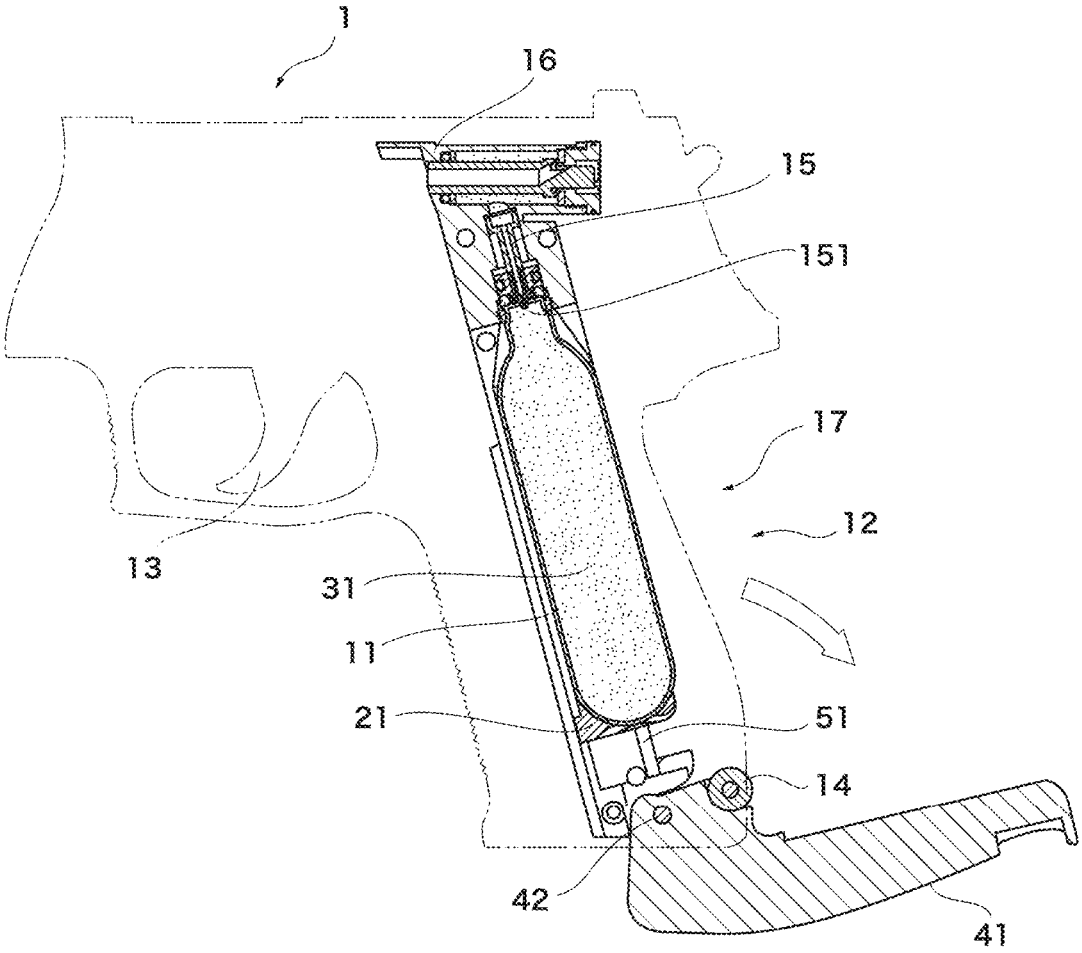
FIG. 2 is a partial front sectional view of a toy gun in an embodiment of the present invention as is in use.
Figure 3:
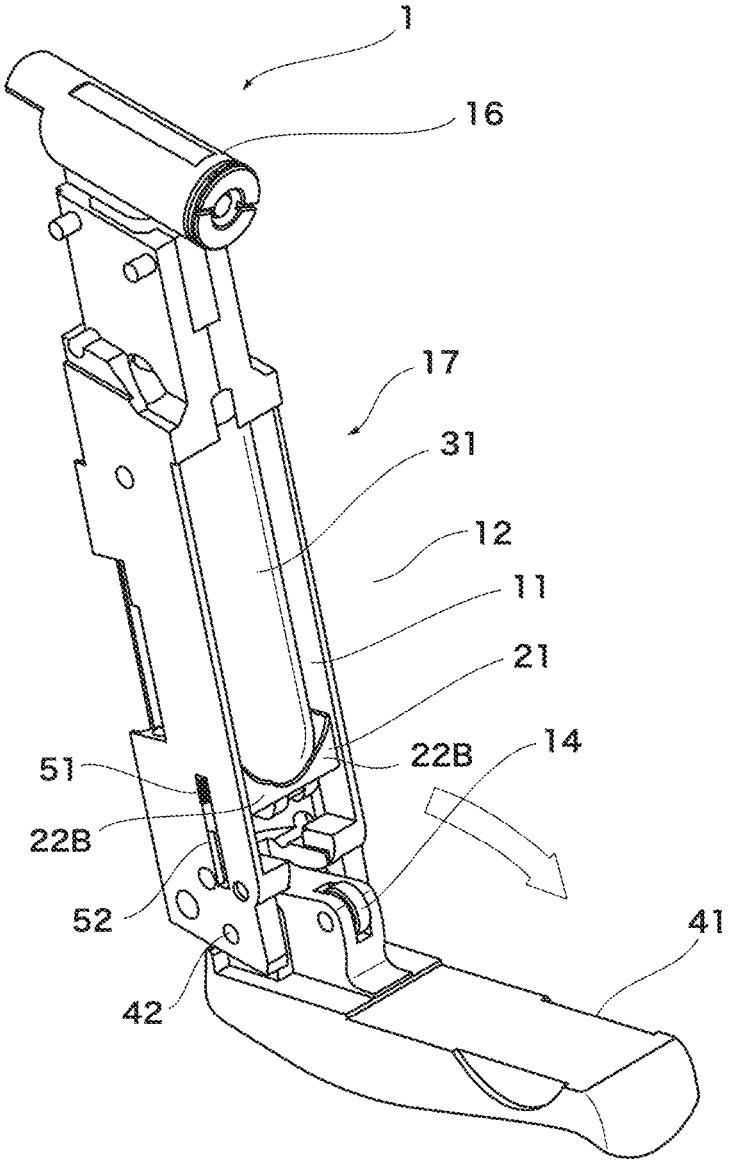
FIG. 3 is a perspective view of a toy gun in an embodiment of the present invention as is in use.

FIG. 2 and FIG. 3 illustrate a state in which gas remains in the gas cylinder 31 and the clamp 41 is opened as indicated by arrows. The clamp 41 is rotated about the clamp pivot 42 to open the opening 17.

Figure 4:
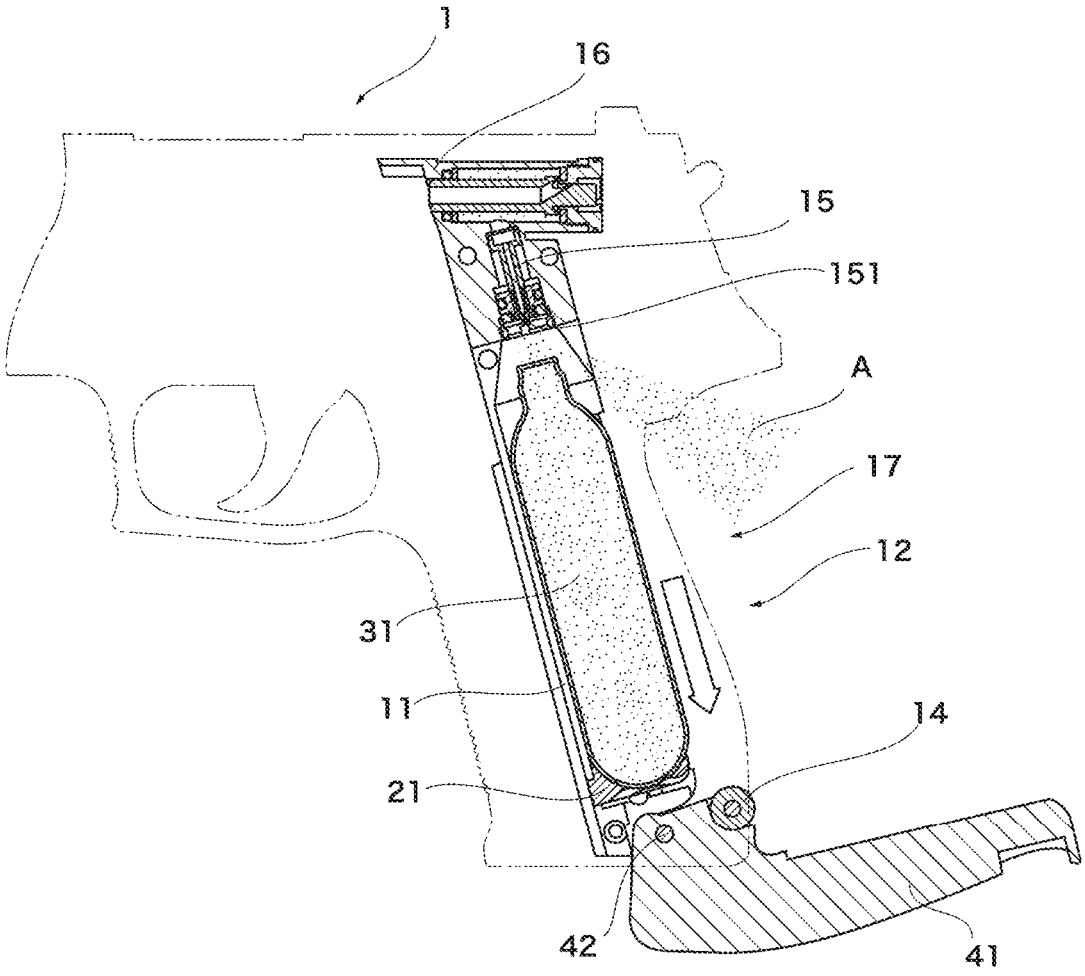
FIG. 4 is a partial front sectional view of a toy gun in an embodiment of the present invention as is in use.
Figure 5:
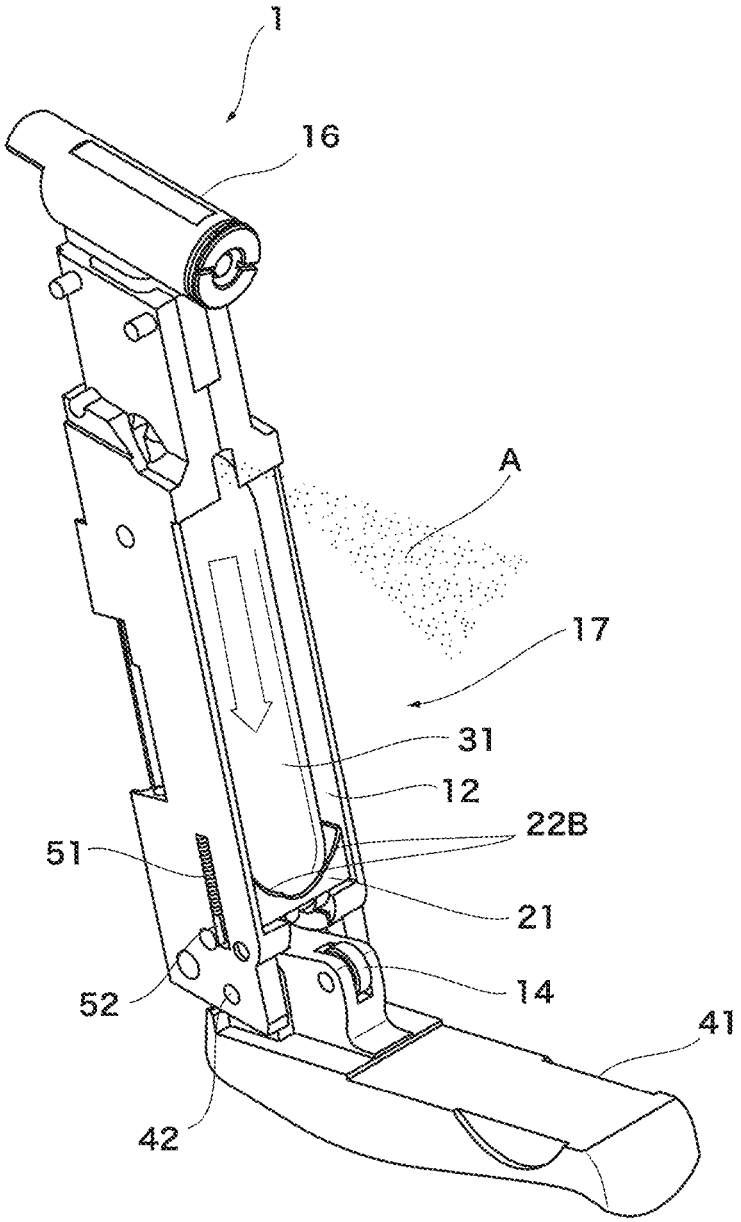
FIG. 5 is a perspective view of a toy gun in an embodiment of the present invention as is in use.

As illustrated in FIG. 4 and FIG. 5, gas A jets out of the unsealed portion of the gas cylinder 31 as soon as the clamp 41 is rotated to open the opening 17. The gas cylinder 31 is pushed as indicated by arrows by the force of the gas and there is a danger that the gas cylinder is blown away. The gas cylinder 31 can fly to any direction and this is very dangerous but this danger is prevented by the raised walls provided around the receptacle 21. The opening side wall 22B and the opening side wall 22B located on both sides of the opening 17 are higher than the rear wall 22C which is located on the rear side and is also a side wall. Therefore, the opening side walls function as a leaping-out preventing portion and prevent the gas cylinder from leaping out of the opening 17 into and from which the gas cylinder 31 is inserted or taken out rearward of the gun 1.

The movement of the gas cylinder 31 is restricted by the opening side wall 22B and the opening side wall 22B located on both sides of the opening, and the gas cylinder 31 cannot be moved other than downward and is moved downward together with the receptacle 21. The gas cylinder 31 is kept pressed downward until the gas is lost.

Figure 6:
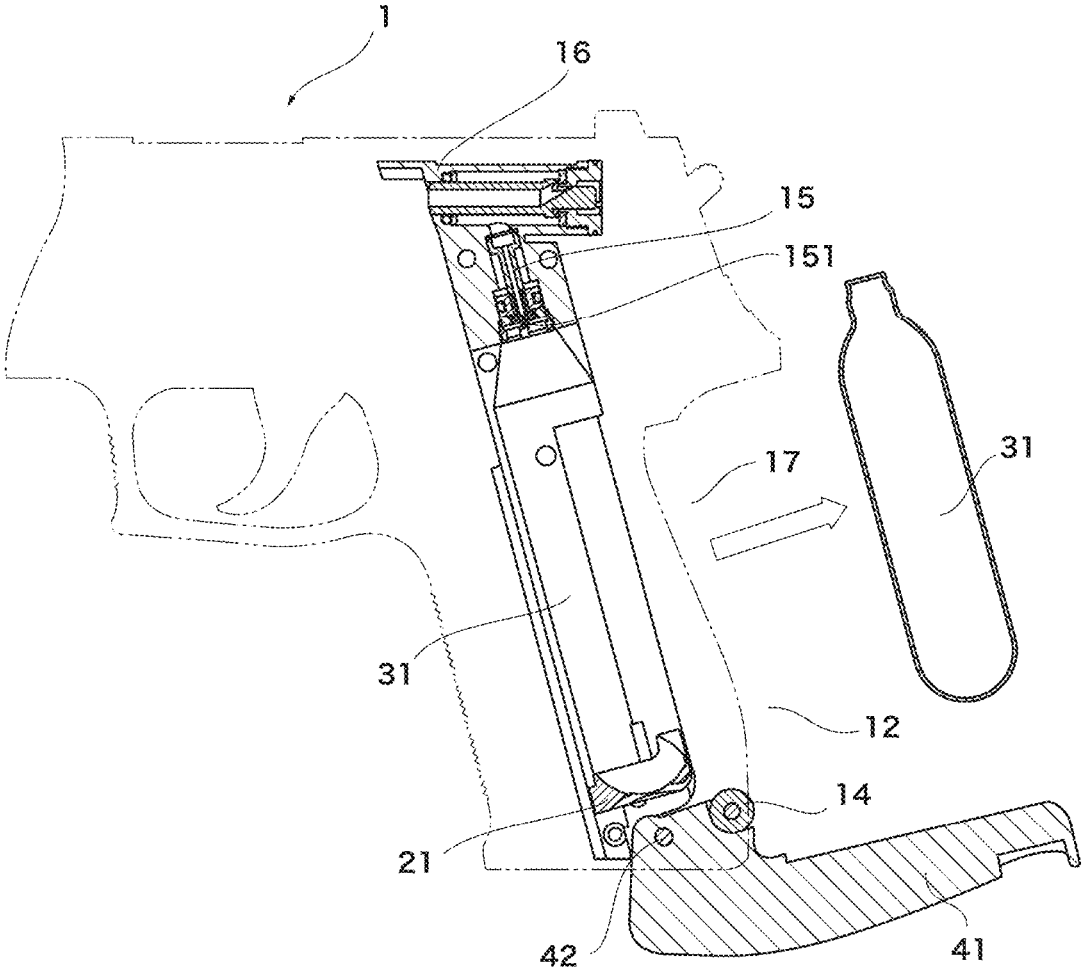
FIG. 6 is a partial front sectional view of a toy gun in an embodiment of the present invention as is in use.
Figure 7:
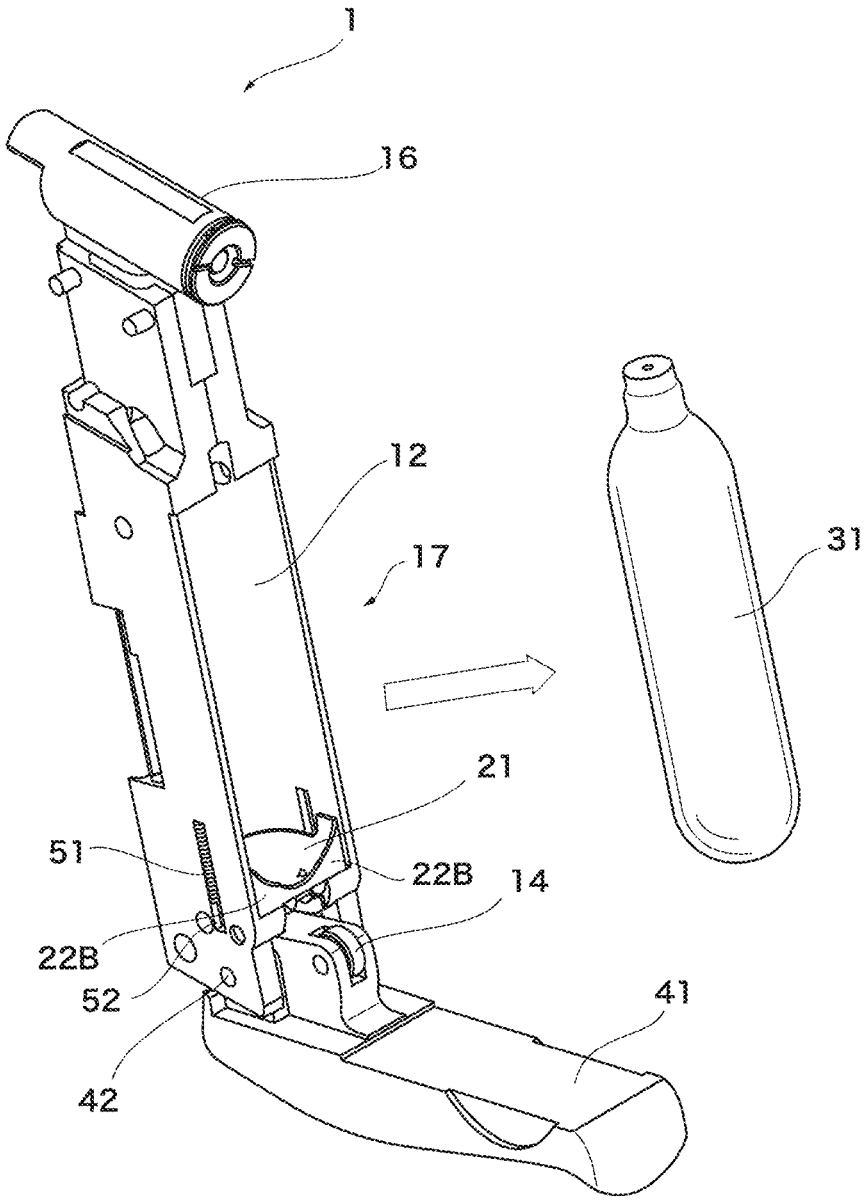
FIG. 7 is a perspective view of a toy gun in an embodiment of the present invention as is in use.
Figure 8:
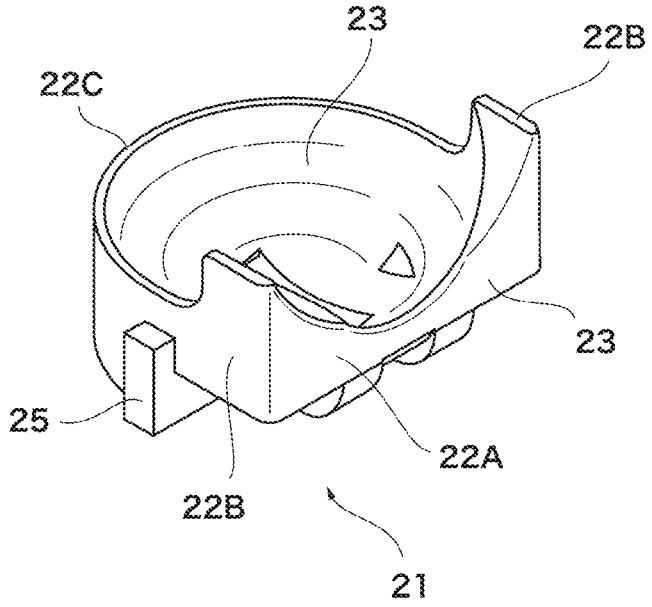
FIG. 8 is a perspective view of a receptacle associated with a toy gun in an embodiment of the present invention.
Figure 9:
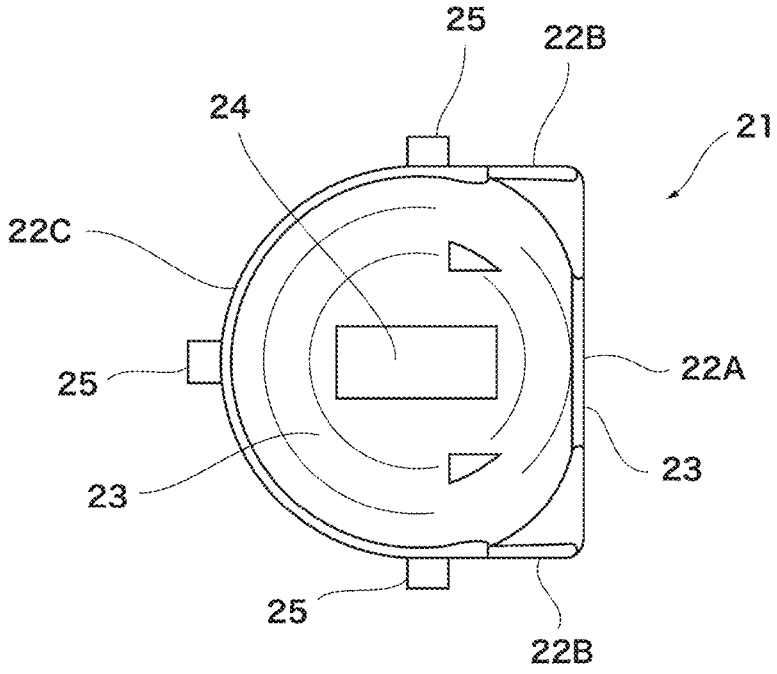
FIG. 9 is a plan view of a receptacle associated with a toy gun in an embodiment of the present invention.
Figure 10:
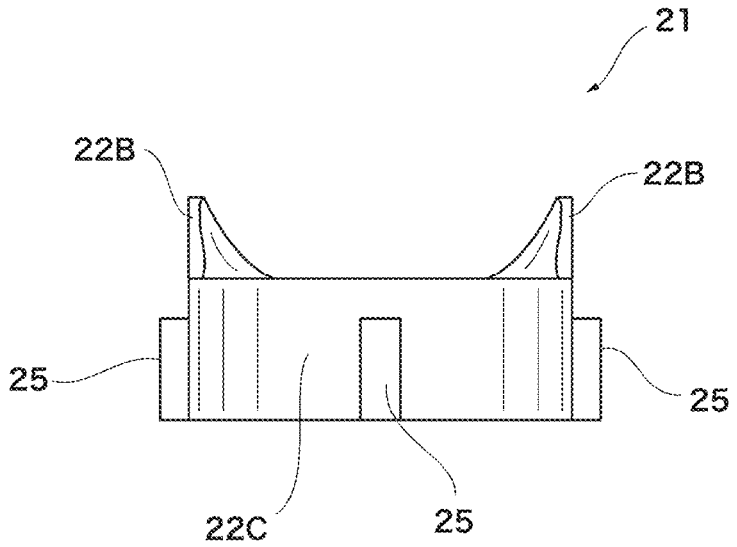
FIG. 10 is a front view of a receptacle associated with a toy gun in an embodiment of the present invention.
Figure 11:
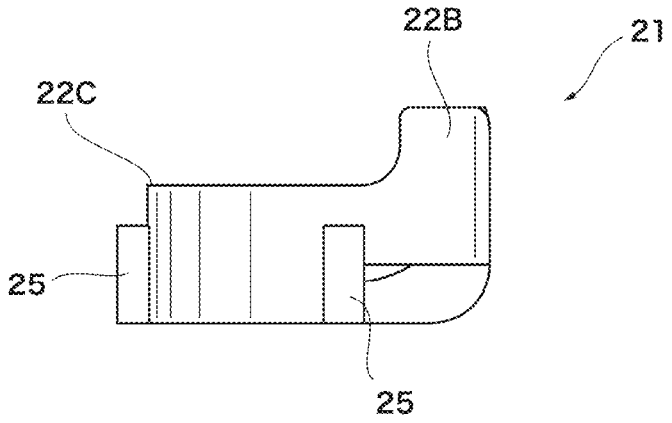
FIG. 11 a side view of a receptacle associated with a toy gun in an embodiment of the present invention.

As illustrated in FIG. 4 and FIG. 5, the receptacle is energized downward by the spring. Therefore, the gas cylinder 31 can be removed from the main body as illustrated in FIG. 6 and FIG. 7 by shaking or turning upside down the gun body.

The receptacle 21 for the prevention of leaping-out is provided between the roller portion 14 and the gas cylinder 31. As a result, the leaping-out of the gas cylinder 31 can be prevented without fail by the receptacle 21 constantly following the released gas cylinder 31.

The receptacle 21 vertically moves. Energizing force is applied downward in the drawings.

This obviates the necessity for separately operating a movable guard to pull out a cylinder. Since an open space is ensured for taking the gas cylinder 31 out of the frame, it is easy to take out the gas cylinder 31.

In addition, the gas cylinder 31 can be inserted or taken out from behind the toy gun 1 by an unsealing method utilizing the principle of leverage, which method used to be dangerous and not to be excisable.

What is claimed is:

1. A toy gun comprising:

a gas cylinder housing portion which is provided in a grip portion of an air gun and houses a gas cylinder;

a clamp which closes or opens the gas cylinder housing portion;

a clamp pivot about which the clamp is rotated;

a roller installed on the clamp; and a receptacle which is installed between an upper part of the roller and a bottom portion of the gas cylinder, is energized toward the roller, has a surface shape matched with a bottom surface shape of the gas cylinder and is provided in a central part with a rectangular hole, wherein the roller protrudes at least slightly through the hole and is configured to abut against the gas cylinder.

2. The toy gun according to claim 1, wherein a bottom face of the gas cylinder is a convex spherical surface and a surface of the receptacle is a concave spherical surface.

3. The toy gun according to claim 1, wherein a periphery of the receptacle is in a raised shape.

4. The toy gun according to claim 2, wherein a periphery of the receptacle is in a raised shape.

5. The toy gun according to claim 3, wherein the raised shape provided on the periphery of the receptacle is higher on an opening side than on a rear side.

6. The toy gun according to claim 4, wherein the raised shape provided on the periphery of the receptacle is higher on an opening side than on a rear side.

7. The toy gun according to claim 5, wherein the receptacle is raised more at corners than in a center on the opening side.

8. The toy gun according to claim 6, wherein the receptacle is raised more at corners than in a center on the opening side.

9. The toy gun according to claim 1, further comprising a biasing member that includes a spring for energizing the receptacle toward the roller.

10. A high-pressure gas cartridge attachment and detachment apparatus for an air gun, the air gun including a grip portion and a gas cylinder housing portion for housing a gas cylinder, the apparatus comprising:

a clamp configured to selectively close and open the gas cylinder housing portion;

a clamp pivot about which the clamp is rotated;

a roller installed on the clamp; and a receptacle which is installed between an upper part of the roller and a bottom portion of the gas cylinder, is energized toward the roller, has a surface shape matched with a bottom surface shape of the gas cylinder and is provided in a central part with a rectangular hole, wherein the roller protrudes at least slightly through the hole and is configured to abut against the gas cylinder.

11. The apparatus according to claim 10, wherein a bottom face of the gas cylinder is a convex spherical surface and a surface of the receptacle is a concave spherical surface.

12. The apparatus according to claim 10, wherein a periphery of the receptacle is in a raised shape.

13. The apparatus according to claim 11, wherein a periphery of the receptacle is in a raised shape.

14. The apparatus according to claim 12, wherein the raised shape provided on the periphery of the receptacle is higher on an opening side than on a rear side.

15. The apparatus according to claim 13, wherein the raised shape provided on the periphery of the receptacle is higher on an opening side than on a rear side.

16. The apparatus according to claim 14, wherein the receptacle is raised more at corners than in a center on the opening side.

17. The apparatus according to claim 15, wherein the receptacle is raised more at corners than in a center on the opening side.

18. The apparatus according to claim 10, further comprising a biasing member that includes a spring for energizing the receptacle toward the roller.

* * * * *